US006308487B1

(12) United States Patent
Cantley

(10) Patent No.: US 6,308,487 B1
(45) Date of Patent: Oct. 30, 2001

(54) PLASTIC LATTICE

(75) Inventor: Richard W. Cantley, 2820 W. Maple, Troy, MI (US) 48084

(73) Assignees: Antoinette Janine Cantley; Richard W. Cantley, both of Troy, MI (US)

( * ) Notice: Subject to any disclaimer, the term of this patent is extended or adjusted under 35 U.S.C. 154(b) by 0 days.

(21) Appl. No.: 09/338,110

(22) Filed: Jun. 23, 1999

Related U.S. Application Data

(60) Provisional application No. 60/116,046, filed on Jan. 14, 1999.

(51) Int. Cl.[7] ..... B44F 7/00

(52) U.S. Cl. ..... 52/660; 52/663; 52/664; 52/669; 52/311.1; 52/311.2

(58) Field of Search ..... 52/311.1, 311.2, 52/311.3, 315, 660, 663, 662, 664, 665, 666, 667, 668, 669; D25/100

(56) References Cited

U.S. PATENT DOCUMENTS

| | | | | |
|---|---|---|---|---|
| D. 296,935 | | 7/1988 | Erceg . | |
| D. 357,073 | | 4/1995 | Reum . | |
| D. 366,532 | | 1/1996 | Herbst et al . | |
| D. 374,485 | * | 10/1996 | Brown | D25/38 |
| D. 402,381 | | 12/1998 | Gruda et al. . | |
| D. 423,687 | * | 4/2000 | Cantley | D25/100 |
| 2,672,658 | | 3/1954 | Pedersen . | |
| 3,716,164 | * | 2/1973 | Fennema | 220/786 |
| 4,268,049 | * | 5/1981 | Salvador | 280/33.996 |
| 4,333,287 | | 6/1982 | Lewis . | |
| 4,907,389 | * | 3/1990 | Pettit | 52/668 |
| 5,080,150 | * | 1/1992 | Deadwyler, Jr. | 141/364 |
| 5,191,985 | * | 3/1993 | Licari | 211/188 |
| 5,657,605 | * | 8/1997 | Sidney | 52/664 |
| 5,795,267 | * | 8/1998 | Weaver | 482/35 |

* cited by examiner

*Primary Examiner*—Christopher T. Kent
*Assistant Examiner*—Jennifer I. Thissell
(74) *Attorney, Agent, or Firm*—Gifford, Krass, Groh, Sprinkle, Anderson & Citkowski, PC

(57) ABSTRACT

A one piece molded plastic lattice simulates a lattice of separate superposed members. The lattice includes a set of continuous elongated members that lie in a plane. A second set of discontinuous elongated members intersects and interconnects the first set of members at junction regions. The second set of discontinuous elongated members may lie in another plane. The upper surfaces of the first set of members is transversely concave, or the upper surfaces of the second set of members is longitudinally convex, so that a discontinuity is created at each of the junction regions. In this way, the plastic lattice creates the illusion of being a multi-piece lattice.

13 Claims, 4 Drawing Sheets

FIG - 1
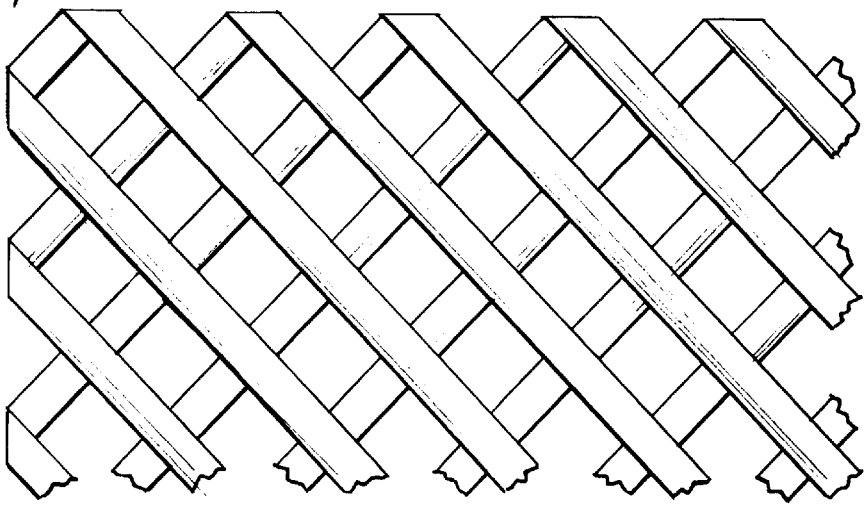
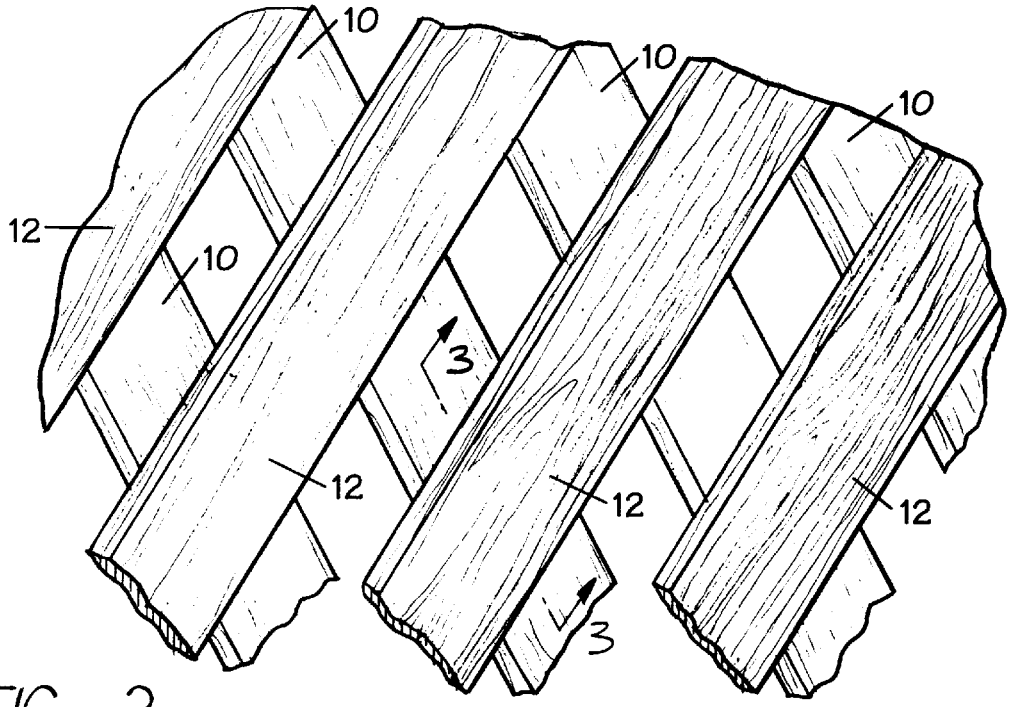
FIG - 2
PRIOR ART
FIG - 3
PRIOR ART
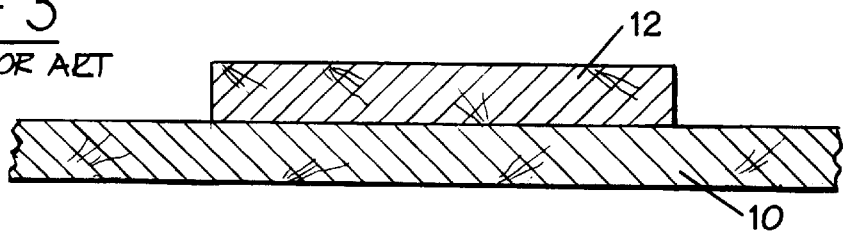

PLASTIC LATTICE

CROSS-REFERENCE TO RELATED APPLICATIONS

This application claims the benefit of United States Provisional Application having Ser. No. 60/116,046 filed Jan. 14, 1999.

FIELD OF THE INVENTION

The present invention relates generally to molded plastic lattice and, more specifically, to a generally two-dimensional plastic lattice with a discontinuity at junction regions so that the illusion of a multi-piece lattice is created.

BACKGROUND OF THE INVENTION

Traditional wood lattice, such as shown in FIGS. 2 and 3, has been long known and used for both decorative and functional purposes, as part of fences, porches, trellises, and other places. Traditional wood lattice consists of a first plurality of individual mutually parallel wooden slats 10 lying in a common plane and a second plurality of individual, mutually parallel wooden slats 12 lying in a second plane. The second plurality of slats 12 runs at an angle to the first plurality of slats 10 and is superposed on the first set of slats 10 to create a mesh-like appearance.

Traditional wood lattice has several drawbacks. First, because the lattice is typically used outdoors and the wood slats are exposed to the elements, the lattice requires periodic maintenance or its appearance will become unacceptable. Secondly, traditional wood lattice is expensive due to the cost of the wood slats and the cost of assembling the slats into a lattice. Another drawback to traditional wood lattice is that a sheet of lattice has a thickness equal to approximately twice the thickness of a single wood slat. For some applications, it is desirable to keep the thickness of the lattice down below a certain size. Traditional wood lattice may be made thinner by making each of the individual slats thinner. However, this reduces the overall strength of the lattice.

There have been numerous attempts to overcome the shortcomings of traditional wood lattice. For example, U.S. Pat. No. 2,672,658 to Pederson shows a wood lattice wherein specific combinations of tongues and grooves are formed such that the first and second sets of slats lie generally in the same plane. This creates a generally two-dimensional wooden lattice with a thickness less than would be created if the first and second sets of slats were superposed upon one another. However, the Pederson invention is expensive and time consuming to create and does not address the maintenance problems associated with wooden lattice. Also, many users prefer that lattice have a three-dimensional appearance. The Pederson invention attempts to create a three-dimensional appearance by the positioning of the wood grain of the various portions of the lattice. However, this is only partially successful as the wood grain will not always be apparent, especially if the lattice is painted.

Another alternative to traditional wood lattice is plastic lattice. Early plastic lattice was created by duplicating the construction of wood lattice. That is, sets of plastic slats, similar in dimension to wood slats, were molded and attached to one another with one set superposed on another set in the same way that wood lattice is formed. This design overcomes the maintenance limitations of traditional wood lattice but fails to address the thickness issue. Also, the cost of molding individual slats and assembling them into sheets of lattice is needlessly expensive. This approach fails to take advantage of one of the major advantages of plastic. That is, plastic molding often allows multiple piece assemblies to be molded as a single body.

Another approach to plastic lattice was two-dimensional plastic lattice. In this design, the first and second sets of slats laid in the same plane. This design allowed the plastic lattice to be molded as a one-piece body thereby giving significant cost advantages over the multi-piece plastic lattice. However, the two-dimensional plastic lattice failed to give the desired three-dimensional appearance of traditional wood lattice and multiple piece plastic lattice.

It is most efficient and cost effective if plastic injection molded parts have a generally uniform thickness throughout so that liquid plastic can flow from one part of the mold to another so that various parts of the injection molded piece cool at similar rates. Therefore, it would be difficult to injection mold a one-piece plastic lattice that exactly duplicated traditional wood lattice, because the areas where the first and second sets of slats overlap would be twice as thick as the portions where they did not overlap. This would lead to uneven cooling and difficulties with the flow of the liquid plastic.

U.S. Design Pat. No. D402,381 to Gruda shows a molded plastic lattice that attempts to create a three-dimensional appearance similar to traditional wood lattice. This plastic lattice is shown in FIGS. 4 and 5. The plastic lattice disclosed in the Gruda patent attempts to give a three-dimensional appearance without having areas that are twice as thick as others. To accomplish this, the first and second sets of plastic slats intersect and overlap so that a majority of both the first and second sets of slats are in the same plane. However, one set of slats is offset from the second set of slats so that it sits above the other set of slats. This creates a three-dimensional appearance even though the first and second sets of slats are not offset as much as traditional wooden slats. However, the overlapping junction areas are only somewhat thicker than the rest of the slats. One drawback to this design is that the thicker junction areas use additional plastic and cool slower when compared to two-dimensional plastic lattice, as discussed previously. Another drawback is that the offsets may hinder the flow of liquid plastic in the mold. Also, the approach disclosed in the Gruda patent creates a lattice that is thicker than two-dimensional plastic lattice.

SUMMARY OF THE INVENTION

The present invention overcomes the limitations of the prior designs discussed above. Plastic lattice according to the present invention is generally two-dimensional while giving a three-dimensional appearance. This effect is created by creating discontinuities at junction regions between first and second pluralities of elongated members. In a preferred embodiment of the present invention, this discontinuity is created by the first set of elongated members having upper surfaces that are transversely concave. Alternatively, the upper surfaces of the second set of elongated members may be longitudinally convex to create the desired discontinuity.

BRIEF DESCRIPTION OF THE DRAWINGS

FIG. 1 is an elevational view of a lattice which may be constructed in a number of ways;

FIG. 2 is a perspective view of a portion of traditional wood lattice;

FIG. 3 is a cross-sectional view of the wood lattice of FIG. 2 taken along lines 3—3 of FIG. 2;

DETAILED DESCRIPTION OF THE PREFERRED EMBODIMENT

Figure 6:
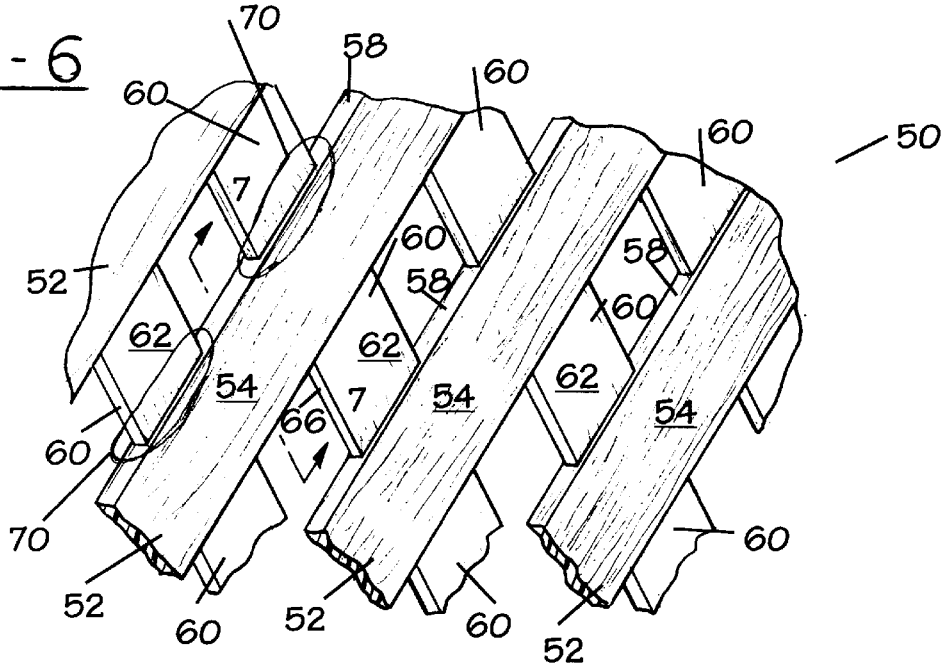
FIG. 6 is a perspective view of a portion of a plastic lattice according to the present invention.
Figure 7:
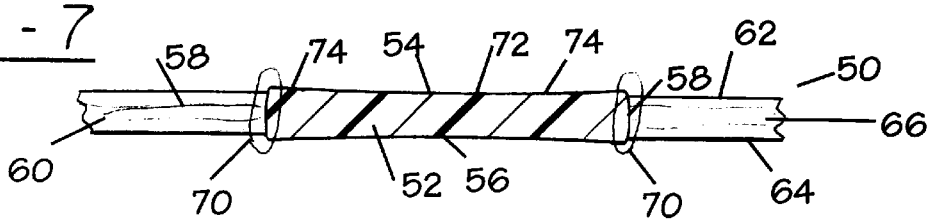
FIG. 7 is a cross-sectional view of the plastic lattice of FIG. 6 taken along lines 7—7 of FIG. 6.

Referring now to FIGS. 6 and 7, a preferred embodiment of a molded plastic lattice is generally shown at 50. The plastic lattice 50 is designed to be generally two-dimensional, as shown in FIG. 7, while giving a three-dimensional appearance, as shown in FIG. 6.

Figure 4:
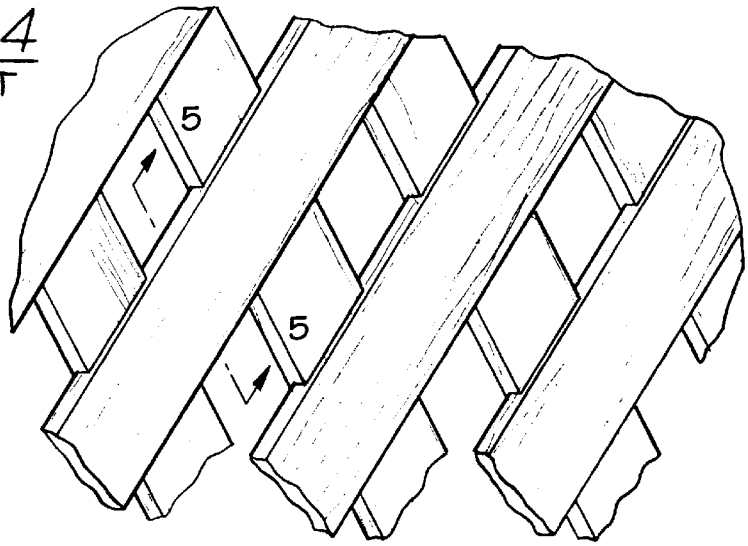
FIG - 4 PRIOR ART
FIG. 4 is a perspective view of a portion of one type of prior art plastic lattice.
Figure 5:
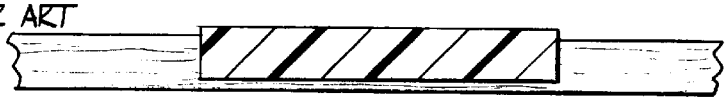
FIG - 5 PRIOR ART
FIG. 5 is a cross-sectional view of the plastic lattice of FIG. 4 taken along lines 5—5 of FIG. 4.

The lattice 50 is a one piece molded plastic body that simulates separate superposed members such as shown in FIGS. 2 and 3. The body includes a first plurality of continuous elongated members 52 which all lie in a common plane. These members 52 simulate a first set of wooden slats. Each member has an upper surface 54, a lower surface 56, and a pair of edges 58 interconnecting the upper 54 and lower 56 surfaces. By "continuous," it is meant that the members 52 appear to be uninterrupted as if each were an elongated wooden slat. The members 52 are parallel to one another and spaced apart by a short distance. The lattice 50 also includes a second plurality of discontinuous elongated members 60 which intersect and interconnect the continuous members 52. By "discontinuous," it is meant that each member 60 appears as if made up of many small sections with each individual section interconnecting a pair of continuous members 52. These individual sections are aligned with one another so as to form a discontinuous member 60. Because the members 60 appear to be discontinuous, they appear to reside below the continuous members 52. The discontinuous members 60 all lie in a common plane and are parallel to one another and spaced apart by a short distance. Preferably, the continuous members 52 and discontinuous members 60 all lie in the same common plane as shown in FIG. 7. This is what is meant when the present invention is referred to as being generally two-dimensional. The continuous members 52 and discontinuous members 60 both lie in the same plane and are not offset three-dimensionally from one another, as was the case with the prior art design shown in FIGS. 4 and 5. The combination of the continuous members 52 and discontinuous members 60 appears to form a lattice of separate superposed members. The discontinuous members 60 each have an upper surface 62, a lower surface 64, and a pair of edges 66 interconnecting the upper and lower surfaces. While it is preferred that the members all lie in a common plane, they could be in separate planes that are offset from one another.

As shown, the continuous members 52 and the discontinuous members 60 intersect at approximately a 90 degree angle. This is a common configuration for lattice. However, the members 52 and 60 may meet at other angles to give a different look. The spaces between the parallel continuous members 52 and the spaces between parallel discontinuous members 60 may be varied to change the look of the lattice. Generally, the spacing between continuous members 52 and the spacing between discontinuous members is similar, though this also could be varied. The width of the members 52 and 60 may also be varied. For example, in some embodiments of the present invention, the members 52 and 60 have a width between 1 and 2 inches and the spacing between members is between 2 and 3 inches. In one particular embodiment, the width of the members is approximately 1.5 inches and the spacing between members is approximately 2.75 inches.

The lattice 50 is preferably injection molded and therefore the continuous members 52 and discontinuous members 60 form a unitary body. That is, the continuous members 52 and discontinuous members 60 are formed as one piece and therefore the members 52 and 60 cannot be truly separated. Instead, the description of the members 52 and 60 as continuous and discontinuous is for ease of description.

Also for ease of description, the areas where the discontinuous members 60 intersect the continuous members 52 are defined herein as junction regions 70. According to the present invention, the three-dimensional appearance of the generally two-dimensional lattice 50 is achieved by having a discontinuity at each of the junction regions 70. That is, there is a slight step between the upper surface 62 of the discontinuous member 60 and the corresponding upper surface 54 of the continuous member 52 at the junction region 70. This slight step or discontinuity creates the illusion that the lattice 50 is three-dimensional. The discontinuity may be achieved in a number of ways. In a preferred embodiment, as shown in FIG. 7, the upper and lower surfaces 54, 56 of the continuous members 52 are slightly concave. The concavity of the surfaces 54, 56 serves two functions. First, the concavity serves to visually distinguish the upper surface 54 of the continuous members 52 from the upper surfaces 62 of the discontinuous members 60, which are preferably not concave. Secondly, the concavity of the surfaces 54, 56 creates slightly raised edges thereby creating a discontinuity at the junction region 70. A most preferred embodiment of a concave upper surface 54 will be described with reference to FIG. 7. In this FIGURE, the upper surface 54 is shown as having a central region 72 and a pair of side regions 74. In the most preferred embodiment, the thickness of the continuous member 52 in the central region 72 is approximately the same as the thickness of the noncontinuous members 60. This helps with the flow of plastic in the mold and provides more uniform cooling. The upper surface 54 slopes slightly upward towards the side regions 74. This causes the continuous member 52 to be slightly thicker at the side region 74 than at the central region 72. In one embodiment, a three degree rise is formed in the upper surface 54 between the central region 72 and each of the side regions 74. That is, the upper surface 54 slopes upwardly from the central region 72 to each of the side regions 74 at approximately three degrees. This causes the side regions 74, in one embodiment, to be approximately 0.030 inch thicker than the central region 72. This also creates a discontinuity of approximately 0.015 inch between each side region and the upper surface 62 of the adjacent discontinuous member 60. The slight concavity of the upper surface 54, the slightly increased thickness at the side regions 74, and the small discontinuities at the junction region 70 create an effective illusion of the lattice 50 being three-dimensional. As shown in FIG. 7, the lower surface 56 is also concave. Preferably, the lower surface 56 is a mirror image of the upper surface 54. However, in some applications the lattice 50 will be viewed from only a single side. In this case, the concavity and discontinuities may be provided on only one side of the lattice 50. The back side may be left entirely flat without discontinuities or concavity.

The concavity of the upper and/or lower surfaces of the continuous members 52 also gives a strength advantage. Because the side regions 74 are thicker than the central regions 72 of the continuous members 52, the continuous members 52 have a "bow-tie" cross-section, as best shown in FIG. 7. This bow-tie cross-section acts like an I-Beam and increases the stiffness of the continuous members 52 and, therefore, the plastic lattice 50.

As shown in FIG. 6, the lattice 50 preferably includes a wood grain pattern on the upper surfaces 54 and 62 of the members 52 and 60 respectively. Preferably, this pattern runs longitudinally on each member to enhance the three-dimensional visual appearance. The wood grain pattern is also preferably included on the lower surfaces 56 and 64 of the members 52 and 60.

Figure 8:
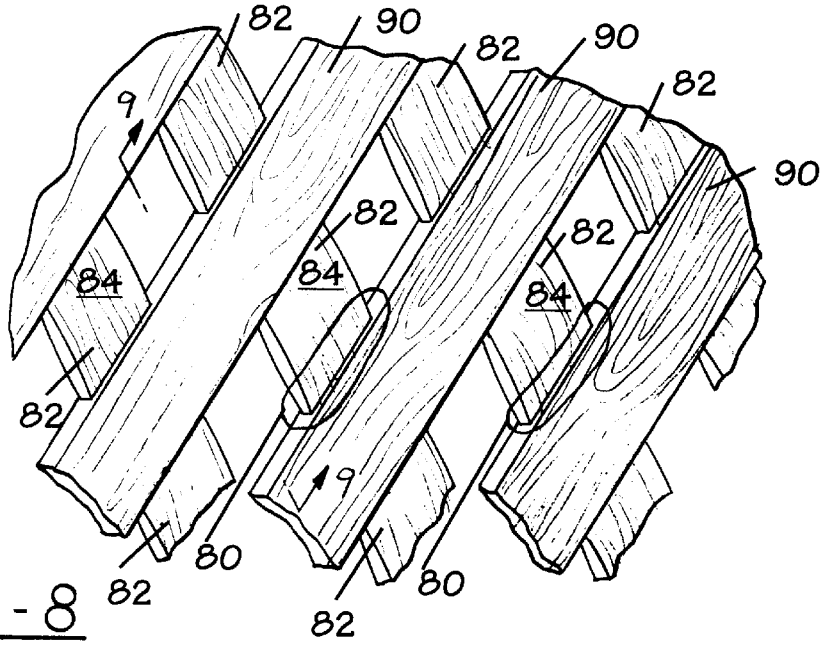
FIG. 8 is a perspective view of a portion of an alternative embodiment of a plastic lattice according to the present invention.
Figure 9:
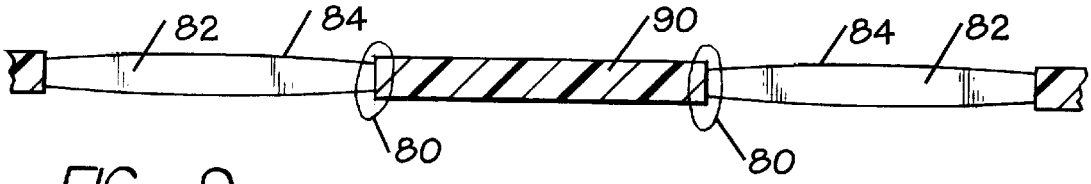
FIG. 9 is a cross-sectional view of the plastic lattice of FIG. 8 taken along lines 9—9 of FIG. 8.
Figure 10:
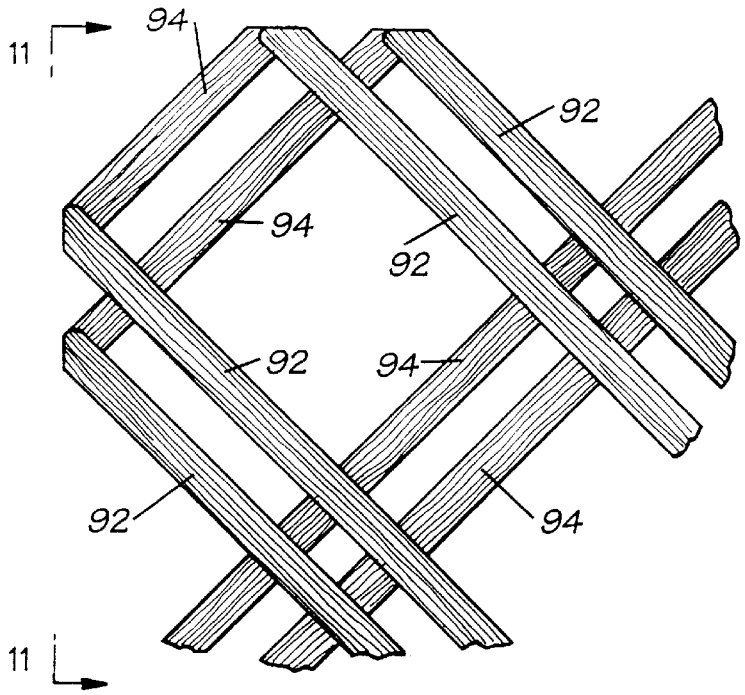
FIG. 10 is a front elevational view of yet another alternative embodiment of a plastic lattice according to the present invention.
Figure 11:
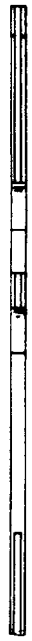
FIG. 11 is a side elevational view of the plastic lattice of FIG. 10, taken along lines 11—11.

In an alternative embodiment, as shown in FIGS. 8 and 9, the discontinuities may be formed at junction regions 80 by making the discontinuous members 82 slightly thinner at each of the junction regions 80. That is, the upper surfaces 84 of the discontinuous members 82 may be made longitudinally convex such that they dip down slightly as they intersect the continuous members 90. In this case, the continuous members 90 may be formed without concave upper surfaces, with the discontinuities at the junction region 80 instead resulting from the thinning of the discontinuous members 82. As yet another alternative, the longitudinal convexity of the upper surfaces 84 of the discontinuous members 82 may be combined with transverse concavity of the continuous members 90 to provide the needed discontinuities at the junction regions 80.

Figure 12:
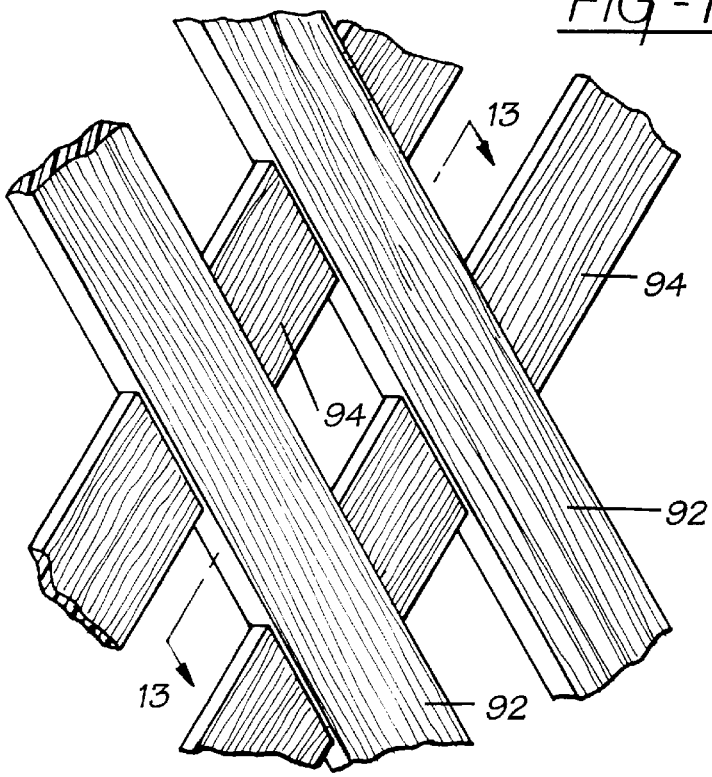
FIG. 12 is a detailed perspective view of a portion of the lattice of FIG. 10.
Figure 13:
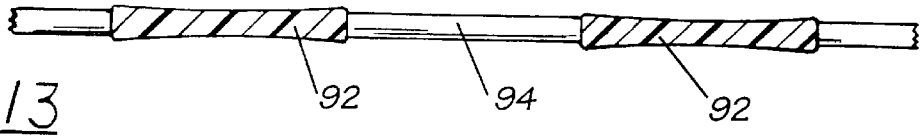
FIG. 13 is a cross-sectional view of the plastic lattice of FIG. 12, taken along lines 13—13.

Yet another alternative embodiment is shown in FIGS. 10–13. This embodiment differs from the first embodiment in that pairs of continuous members 92 are positioned close to one another with a larger space left between adjacent pairs. This gives a different aesthetic appearance. The discontinuous members 94 are likewise formed in closely spaced pairs with each pair spaced from the adjacent pair by a greater distance. Obviously, the spacing may be varied so as to give a variety of different appearances. As shown in FIGS. 12 and 13, discontinuities between the continuous 92 and discontinuous 94 members are formed in the same way as for the first embodiment. Likewise the paired look of FIG. 10 could be achieved through the other previously discussed approaches to forming discontinuities.

As will be clear to one of skill in the art, other variations may be made upon the described and illustrated preferred embodiments without departing from the scope or intent of the present invention. Therefore, the preceding description and figures should be interpreted broadly. It is the following claims, including all equivalents, that define the scope of the present invention.

What is claimed is:

1. A one piece molded plastic body simulative of a lattice of separate superposed members, the body comprising:

a first plurality of continuous elongated members lying in a first plane, each of the members having an upper surface, a lower surface, and a pair of edges interconnecting the upper and lower surfaces;

a second plurality of discontinuous elongated members intersecting and interconnecting the first plurality of members at a plurality of junction regions, each of the members in the second plurality lying in a second plane and having an upper surface, a lower surface, and a pair of edges interconnecting the upper and lower surfaces;

wherein the upper surfaces of the members in the first plurality are transversely concave or the upper surfaces of the members in the second plurality are longitudinally convex, so that a discontinuity is created at the junction regions;

whereby the body creates the illusion of a multi-piece lattice.

2. The one piece molded plastic body according to claim 1 wherein the second plurality of discontinuous members intersects the first plurality at approximately 90 degrees.

3. The one piece molded plastic body according to claim 1 wherein the first plane and the second plane are generally coplanar.

4. The one piece molded plastic body according to claim 1 wherein the upper surfaces of the members in the first plurality are transversely concave and the lower surfaces of the members in the first plurality are transversely concave such that a central region of each of the members in the first plurality is thinner than a side region of each of the members in the first plurality.

5. The one piece molded plastic body according to claim 1 wherein the upper surfaces of the members in the first plurality are transversely concave such that a central region of each of the members in the first plurality is thinner than a side region of each of the members in the first plurality with the upper surface sloping upwardly from the central region to the corresponding side region at an angle of approximately 3 degrees.

6. The one piece molded plastic body according to claim 1 wherein the upper surfaces of the members in both the first and second plurality have a wood grain disposed thereon.

7. A one piece molded plastic body simulative of a lattice of separate superposed members, the body comprising:

a first plurality of continuous elongated members lying in a first plane, each of the members having an upper surface, a lower surface, and a pair of edges interconnecting the upper and lower surfaces;

a second plurality of discontinuous elongated members intersecting and interconnecting the first plurality of members at a plurality of junction regions, each of the members in the second plurality lying in a second plane and having an upper surface, a lower surface, and a pair of edges interconnecting the upper and lower surfaces;

wherein a major portion of the upper surfaces of each of the members in the first plurality is coplanar, a major portion of the upper surfaces of each of the members in the second plurality is coplanar, and a minor portion of the upper surfaces of each of the members in the first plurality or in the second plurality deviates from the respective planarity so that a discontinuity is created at the junction regions;

whereby the body creates the illusion of a multi-piece lattice.

8. The one piece molded plastic body according to claim 1 wherein the second plurality of discontinuous members intersects the first plurality at approximately 90 degrees.

9. The one piece molded plastic body according to claim 7 wherein the first plane and the second plane are generally coplanar.

10. The one piece molded plastic body according to claim 7 wherein the upper surfaces of the members in the first plurality are transversely concave such that a central region of each of the members in the first plurality is thinner than a side region of each of the members in the first plurality, the central region corresponding to the major portion of each of the upper surfaces and the side regions corresponding to the minor portion of each of the upper surfaces.

11. The one piece molded plastic body according to claim 10 wherein each upper surface slopes upwardly from the central region to the corresponding side region at an angle of approximately 3 degrees.

12. The one piece molded plastic body according to claim 1 wherein the upper surfaces of the members in both the first and second plurality have a wood grain disposed thereon.

13. A one piece molded plastic body simulative of a lattice of separate superposed members, the body comprising:

a first plurality of continuous elongated members lying in a first plane, each of the members having an upper surface, a lower surface, and a pair of edges interconnecting the upper and lower surfaces;

a second plurality of discontinuous elongated members intersecting and interconnecting the first plurality of members at a plurality of junction regions, each of the members in the second plurality also lying in the first plane and having an upper surface, a lower surface, and a pair of edges interconnecting the upper and lower surfaces;

wherein the upper surfaces and lower surfaces of the members in the first plurality are transversely concave, so that a discontinuity is created at the junction regions;

whereby the body creates the illusion of a multi-piece lattice.

* * * * *